US005875508A

United States Patent [19]

Hale

[11] Patent Number: 5,875,508

[45] Date of Patent: Mar. 2, 1999

[54] HYDROSTATIC SEWER CLEANING MACHINE

[75] Inventor: C. David Hale, Wilmington, Ohio

[73] Assignee: Electric Eel Manufacturing Co., Inc., Springfield, Ohio

[21] Appl. No.: 787,790

[22] Filed: Jan. 23, 1997

[51] Int. Cl.[6] ..... B08B 9/02

[52] U.S. Cl. ..... 15/104.31; 15/104.095

[58] Field of Search ..... 15/104.095, 104.096, 15/104.12, 104.31, 104.33

[56] References Cited

U.S. PATENT DOCUMENTS

| | | | |
|---|---|---|---|
| 3,176,335 | 4/1965 | Ciaccio | 15/104.33 |
| 3,393,415 | 7/1968 | Ciaccio | 15/104.33 |
| 3,394,422 | 7/1968 | Siegal | 15/104.33 |
| 3,399,415 | 9/1968 | Hammond | 15/104.33 |
| 3,399,417 | 9/1968 | Hammond | 15/104.33 |
| 4,839,936 | 6/1989 | Prange | 15/104.33 |

*Primary Examiner*—Randall E. Chin
*Attorney, Agent, or Firm*—Frost & Jacobs LLP

[57] ABSTRACT

A hydrostatic sewer cleaning machine for driving a cable and cleaning tool in from 6 inch to 30 inch diameter sewer lines. The sewer cleaning machine comprises a wheeled base having a baffled hydraulic fluid reservoir therebeneath and an inverted U-shaped operator's handle at its rearward end. A prime mover, a hydraulic pump and a hydraulic motor are mounted on the base. The primer mover drives the hydraulic pump which is connected to the reservoir. The hydraulic pump is connected to the hydraulic motor. The hydraulic pump has a control valve which controls the direction and the amount of flow of the hydraulic fluid to the hydraulic motor. The pump control valve is operated, via a cable, by a control lever mounted on the operator's handle. The pump also has a manual relief valve by which the static pressure in the system can be released. The hydraulic motor output is connected through a slip clutch to the cable which drives an appropriate remote cleaning tool. The sewer cleaner can have its speed controlled and be immediately and directly shifted to any one of forward, reverse, and neutral, by the control lever. Full torque is available, throughout 95 percent of the rpm range of the hydraulic motor in both forward and rearward directions.

18 Claims, 3 Drawing Sheets

HYDROSTATIC SEWER CLEANING MACHINE

TECHNICAL FIELD

The present invention is directed to a sewer cleaning machine of the type having a drive mechanism for an elongated cable which terminates at its forward end in a sewer cleaning tool, and more particularly to such a machine capable of speed adjustment and instant shifting to forward, reverse or neutral by a single manual lever and characterized by providing maximum torque throughout 95 percent of its rpm range.

BACKGROUND ART

Prior art workers have devised various embodiments of sewer cleaning machines of the type comprising an elongated cable provided at its forward end with a sewer cleaning tool. The cable is caused to rotate, which in turn imparts rotation to the cleaning tool. Rotation of the cable and cleaning tool in the forward direction, will cause them to advance through the sewer pipe being cleaned. When an obstruction is reached, the cleaning tool will remove the obstruction by a cutting action.

A typical prior art sewer cleaning machine is provided with a prime mover usually in the form of a gasoline or diesel engine. The output shaft of the engine is connected to the cable by means of a geared transmission and a clutch, usually of the automotive type. The transmission output is connected to the cable by an appropriate cable connector. The transmission has a shift lever normally having first, second and third forward positions, and a reverse position. The clutch is actuated by a foot pedal and the engine is provided with a throttle; usually a manual throttle. As a result, the operator of the prior art tool will generally be required to work a manual throttle, a manual gear shift lever and a clutch foot pedal.

In use, the operator will shift the transmission through first, second and third gear to drive the cleaning tool rapidly through the pipe until an obstruction is encountered. At that point, the operator will shift to first or low gear and will adjust for maximum throttle to obtain maximum torque. As a result, the cutting and grinding action is carried out at a relatively low speed of from about 150 to 350 rpm.

An experienced operator can determine, by "feel" and from the appearance of the cable, when he has encountered a particularly difficult obstruction to clear. In particularly difficult instances, the cable may tend to loop or kink. When a difficult obstruction is encountered, the operator will generally depress the clutch and shift the transmission into reverse. It may be that the operator will have to shift between first and reverse many times in order to force the cleaning tool through the obstruction. It will be evident that, in the use of this type of sewer cleaning machine, the operator is substantially constantly manipulating one or more of the throttle, the gear shift and the clutch.

The present invention is based upon the discovery that the prime mover may be used to drive a hydraulic pump. The hydraulic pump, in turn, is used to drive a geared hydraulic motor. The output of the hydraulic motor is connected to the cable through a slip clutch, which serves as a torque limiter. The hydraulic pump is provided with a control valve which controls both direction of flow and amount of flow of the hydraulic fluid, and thus the direction of rotation and the rpm of the hydraulic motor output shaft.

A great many advantages result from this arrangement. First of all, the prime mover or engine runs at constant speed and frequent throttle manipulation is eliminated. The transmission and clutch are also eliminated. Maximum torque is achieved throughout 95% of the rpm range of the hydraulic motor.

The control valve of the hydraulic pump can, itself, be controlled by a lever actuated cable. When the manual control lever is in a central position, the sewer cleaning machine is in an idle mode wherein the pump control valve is set to cause the pump to simply withdraw and return hydraulic fluid to the hydraulic fluid reservoir. As the manual lever is moved forwardly, it will cause the hydraulic motor output, the cable and the cleaning tool to rotate in a forward direction. The rpm rate or speed of rotation will increase, as the lever is pushed forwardly. When the lever is pulled rearwardly from its central position, the elements will rotate in a reverse direction and speed will increase as the lever is pulled rearwardly. Maximum torque is constant above 50 rpm.

The present invention provides full speed control in either direction with maximum torque and maximum cutting ability at any forward or reverse speed above 50 rpm. The sewer cleaner may be shifted between forward and reverse instantly. Finally, both speed and direction can be controlled by the simple manual manipulation of a single lever.

DISCLOSURE OF THE INVENTION

According to the invention there is provided a hydrostatic sewer cleaning machine of the type having an elongated cable connected at its forward end to a cleaning tool. The sewer lines may have a diameter of from about 6 inches to about 30 inches. The sewer cleaning comprises a wheeled base having a baffled hydraulic fluid reservoir beneath its upper surface. An inverted U-shaped handle for use by the operator is attached at the rearward end of the base. The base supports a prime mover, a hydraulic pump, and a hydraulic motor. The prime mover drives the hydraulic pump at a constant speed. The hydraulic pump is connected both to the reservoir containing hydraulic fluid and to the hydraulic motor. The hydraulic motor is connected to a slip clutch which, by means of a coupling, is attached to the cable.

The hydraulic pump is provided with a control valve which determines the direction and the rate of flow of the hydraulic fluid to the hydraulic motor. The pump control valve is operated by a cable connected to a manual lever mounted on the operator's handle. The pump has a manual (by-pass) relief valve by which the static pressure in the system can be relieved enabling the easy connection and disconnection of the cable to the slip clutch output. As a result of the above, both the speed and the direction of rotation of the cable and cleaning tool can be controlled by a single manual lever. The direction of rotation of the cable and cleaning tool can be changed substantially instantaneously. Maximum torque is maintained, in either direction, throughout 95 percent of the rpm range of the hydraulic motor.

DETAILED DESCRIPTION OF THE INVENTION

Figure 1:
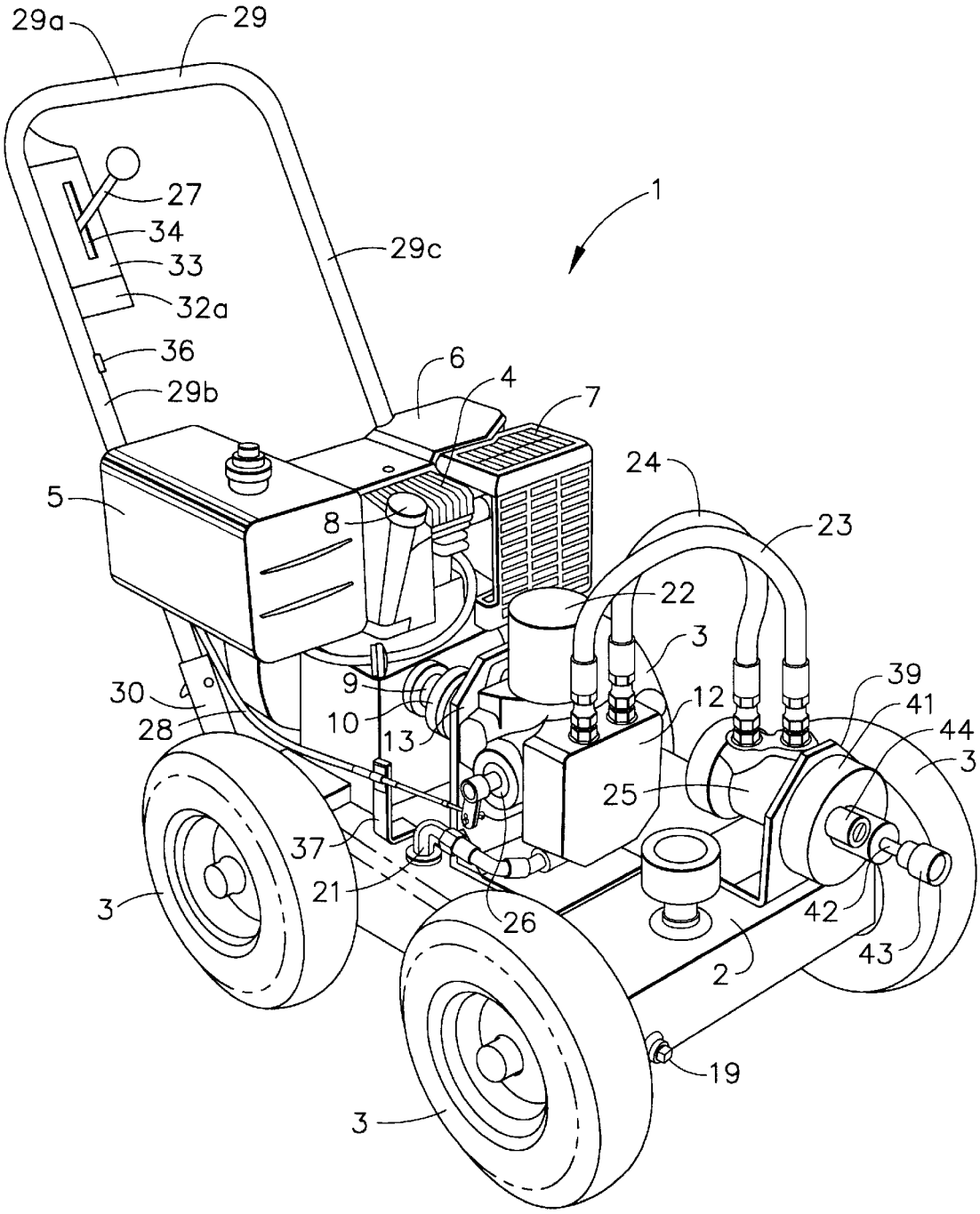
FIG. 1 is a top, front and right-side perspective view of the sewer cleaning machine of the present invention.

Throughout the drawings, like parts have been given like index numerals. The following description refers to all three of the drawings.

The sewer cleaning machine of the present invention is generally indicated at 1 in the drawings. The machine comprises a base 2, preferably made of steel. The base 2 is provided with wheels, preferably provided with balloon tires 3.

Mounted on base 2 there is a prime mover 4. It will be understood by one skilled in the art that the prime mover can take various forms such as a gasoline engine, a diesel engine, or an electric engine. Although not intended to be limiting, for purposes of the present description, the sewer cleaning machine is illustrated as having a gasoline powered engine 4. Excellent results have been achieved, for example, with an 8 Hp gasoline engine manufactured by Briggs and Stratton of Wanwatosa, Wis. The engine 4 is shown as having a fuel tank 5, an air cleaner 6, a muffler 7 and an oil fill and dip stick assembly 8, all as is well known in the art.

Figure 2:
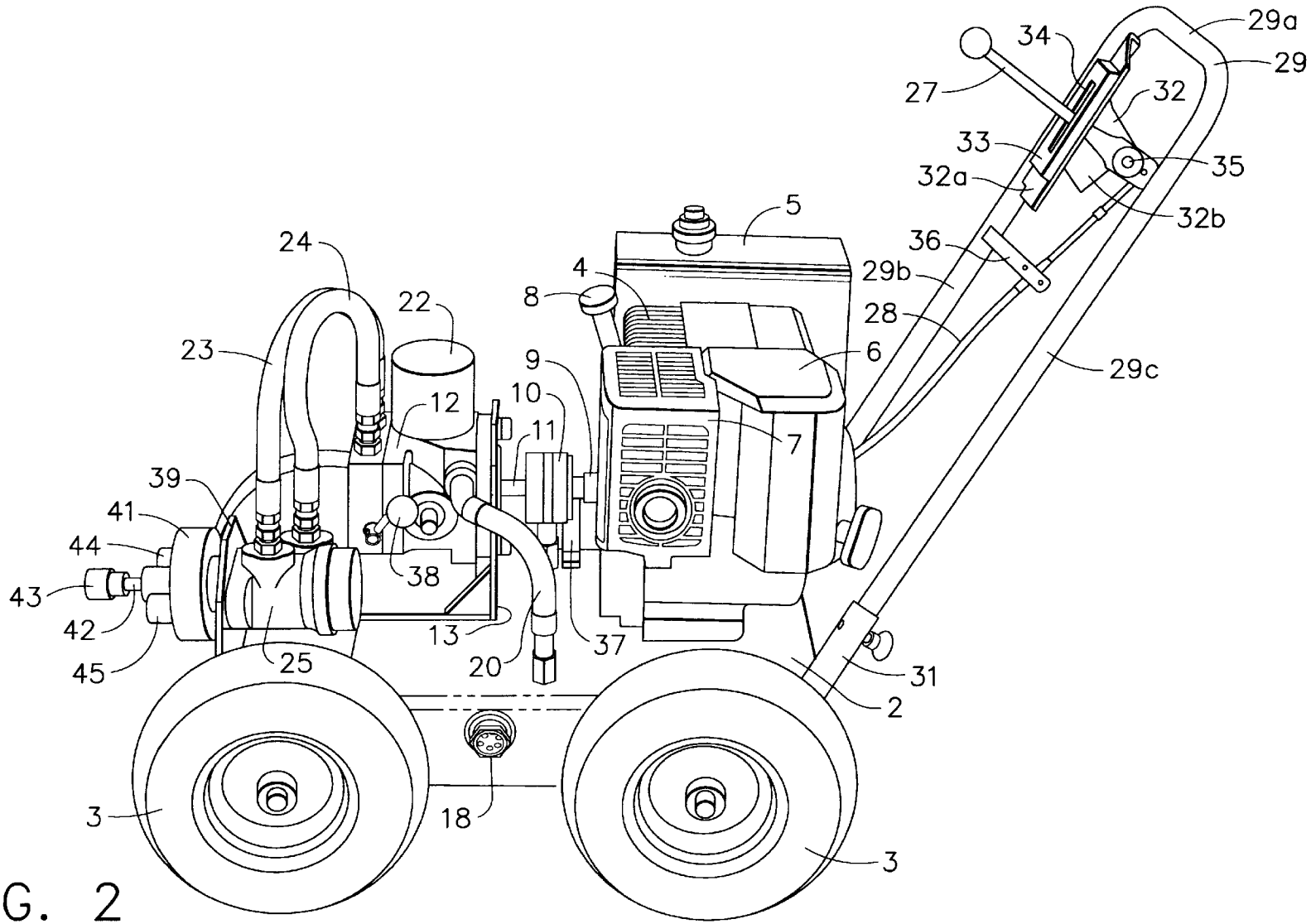
FIG. 2 is a top and left side perspective view of the sewer cleaning machine.

The engine 4 has an output shaft 9. The shaft 9 is connected by a conventional coupling 10 to the input shaft 11 of a hydraulic pump 12 (as best shown in FIG. 2). The pump 12 is mounted on a vertical bracket 13. The vertical bracket 13 is affixed to the upper surface of the base 2.

Figure 3:
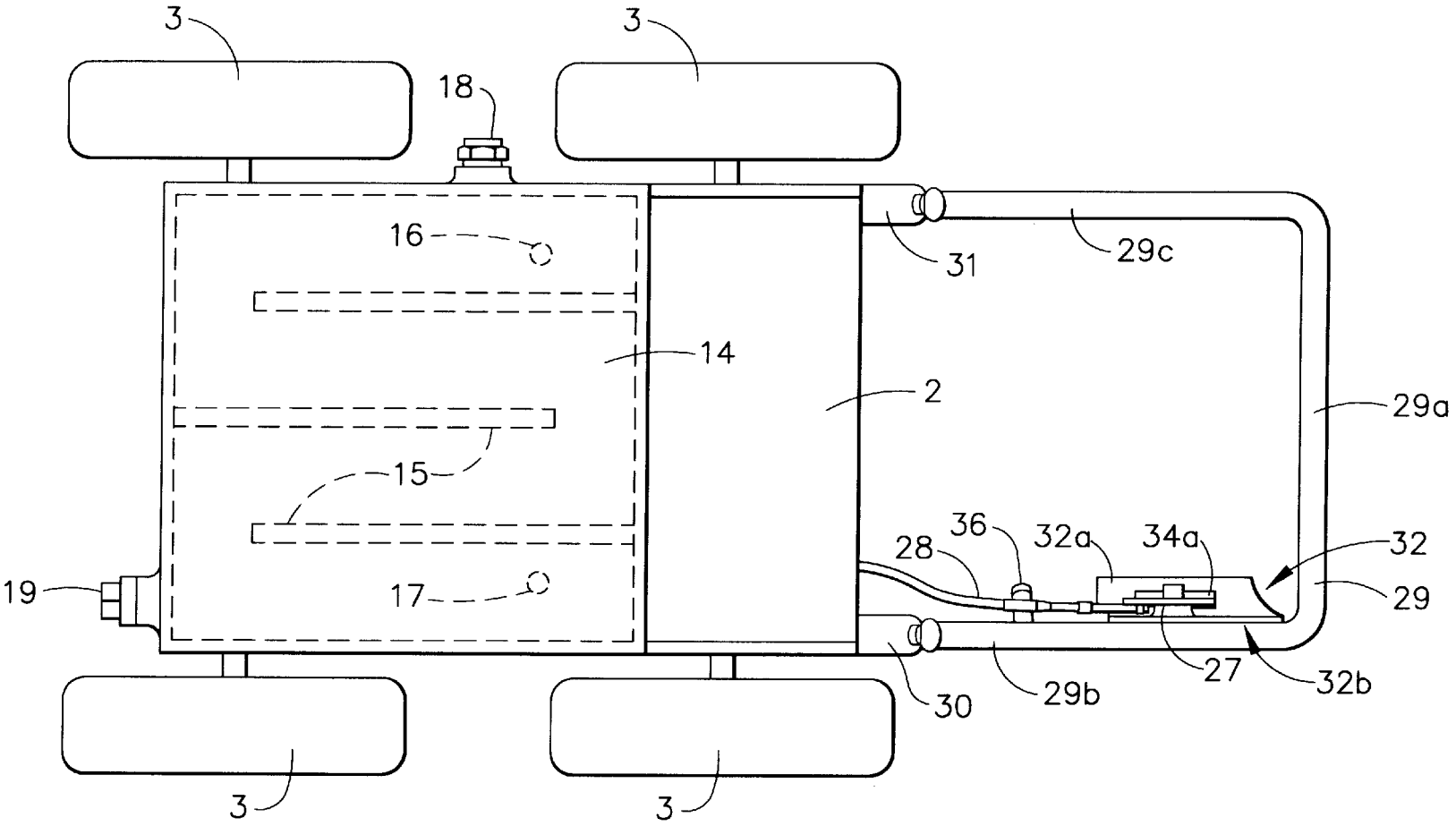
FIG. 3 is a bottom view of the sewer cleaning machine of the present invention.

The base 2 incorporates in its construction a reservoir for hydraulic fluid. The reservoir is best seen in FIG. 3 and is indicated at 14. Preferably, the reservoir is provided with baffles 15. The upper surface of base 2 has an outlet port 16 and a return port 17 for reservoir 14. The reservoir is completed by the provision of a site glass 18 and a drain 19.

The pump 12 has a hydraulic fluid intake conduit 20 (see FIG. 2), threadedly connected to the reservoir outlet 16. Similarly, the pump 12 has a hydraulic fluid return conduit 21 (see FIG. 1), threadedly connected to the, reservoir return port 17.

Pump 12 is provided with an oil filter 22 and a pair of flexible, high pressure, hydraulic fluid lines 23 and 24 by which the pump 12 is connected to hydraulic motor 25.

Hydraulic pump 12 has a control valve 26 which controls both the rate of flow and the direction of flow of hydraulic fluid from pump 12 to hydraulic motor 25 via conduits 23 and 24. The control valve 26 is operated by a remote manual lever 27 connected to control valve 26 by a push-pull cable 28.

To maneuver and properly locate the sewer cleaning machine 1, an inverted U-shaped handle 29 is provided. The handle 29 has an upper base portion 29*a* and downwardly depending legs 29*b* and 29*c*. The free ends of the legs 29*b* and 29*c* are removably received in and attached to a pair of sockets 30 and 31 welded or otherwise appropriately affixed to base 2, adjacent its rearward end.

As is clearly shown in FIGS. 1 and 2, the leg 29*b* of handle 29 supports an L-shaped bracket 32 having a transversely extending portion 32*a* and a rearwardly extending portion 32*b*. Bracket portion 32*a* mounts a lever plate 33 having an elongated slot 34 formed therein. Bracket portion 32*a* has a corresponding slot 34*a* and it will be noted that the manual lever 27 passes through these slots. Lever 27 is pivotally attached to bracket portion 32*b* as at 35. The cable 28 is attached to the rearwardmost end of lever 27. Cable 28 passes through a cable holder 36 affixed to handle portion 29*b*. The cable also passes through a cable holder 37 affixed to base 2. The operation of lever 27, cable 28 and control valve 26 will be set forth hereinafter.

Pump 12 also has a manual relief valve 38, the purpose of which will be set forth hereinafter. Pumps of the type just described are readily available. Excellent results have been achieved, for example, utilizing a pump manufactured by Sauer Sunstrand, of Ames, Iowa, under the designation Series 15. This pump is of the variable swashplate type.

Hydraulic motor 25 is preferably of the geared type and should be properly matched with the pump 12 from the standpoint of output torque and speed. The hydraulic motor 25 is affixed to base 2 by an upstanding bracket 39. The output shaft (not shown) of motor 25 is connected by a coupling (not shown) to the input shaft (not shown) of a conventional dual-disk slip clutch 41. Slip clutch 41 acts as a torque limiter. Slip clutch 41 has an output shaft 42 terminating in a coupling 43 by which output shaft 42 may be connected to the sewer cleaning machine cable and cleaning tool (not shown). The coupling 43 may be of any appropriate design. A coupling suitable for this purpose is taught in U.S. Pat. 2,880,435. Similarly, the cable of the sewer cleaning machine may be of any appropriate type. The dual cable coupling taught in U.S. Pat. 2,880,435 is also suitable for this purpose. Cleaning tools for sewer cleaning machines of the cable-turning type are well known and any appropriate cleaning tool can be employed by the sewer cleaning machine of the present invention. Preferably, the cleaning tool is designed to cut in both rotational directions to take full advantage of the present invention.

As is shown in FIGS. 1 and 2, slip clutch 41 has a pair of sockets 44 and 45 formed thereon. Each socket contains an adjustment screw by which the springs which provide clutch face pressure can be adjusted to determine the breakaway torque, i.e. the torque in the cable at which the clutch will slip. In determining the breakaway torque, a number of factors are considered such as the type of cable, the length of cable, the nature of the obstructions encountered, and the like.

As indicated above, pump 12 is provided with a manual relief valve 38. The manual relief valve connects the pump output orifice directly to the reservoir before it reaches the pump control valve. This drops the system pressure so that coupling 43 can be connected or disconnected from the sewer cleaning machine cable.

The sewer cleaning machine of the present invention having been described in detail, the operation thereof can now be set forth. With the engine 4 running, and the control lever 27 centered with respect to slot 34 (as shown in FIGS. 1 and 2), the sewer cleaning machine is in a neutral or idle mode with the output shaft of hydraulic motor 25 not rotating. This is true because the control valve 26 of hydraulic pump 12 is so positioned as to cause hydraulic fluid to flow between the pump 12 and the reservoir 14. If the lever 27 is moved forwardly in slot 34, hydraulic fluid begins to flow between pump 12 and hydraulic motor 25 causing the hydraulic motor output shaft, the cable (not shown) and the cutting tool (not shown) to rotate and advance in a forward direction in the pipe to be cleaned. As the control lever 27 is advanced forwardly in slot 34, the speed (rpm) of rotation of the hydraulic motor output shaft is increased.

It will be understood by one skilled in the art that if the control lever 27 is pulled rearwardly of center in slot 34, the hydraulic pump control valve will reverse the direction of flow of the hydraulic fluid, reversing the direction of rotation of the motor output shaft, cable and cleaning tool. Again, the more the control lever 27 is shifted rearwardly in slot 34, the greater will be the speed of the reverse rotation of the hydraulic motor output shaft, the cable and the cleaning tool.

When the hydraulic pump is running the hydraulic motor in either direction, hydraulic fluid is withdrawn from the reservoir by the hydraulic pump and directed through the hydraulic motor. From the hydraulic motor, the hydraulic fluid returns to the hydraulic pump and thence to the reservoir.

An exemplary embodiment, made in accordance with the teachings above, was provided with the above-described 8 horsepower motor and hydraulic pump. The hydraulic motor was manufactured by Danfoss Fluid Power of Racine, Wis., under the designation DS-50. The output shaft of the hydraulic motor provided an infinitely variable drive speed of from 0 to 1,000 rpm in both forward and reverse operation. Torque is applied to the cable of up to 925 inch pounds, the maximum torque being available within the range of 50 rpm to 1,000 rpm. Thus, full torque is available throughout 95 percent of the rpm range in both forward and reverse operation.

The operator will power the cable rapidly at maximum rpm to the first blockage. When the blockage is reached, which can be determined by "feel" and the appearance of the cable, the operator may reduce the rpm, but the full cable torque will remain unchanged. When the obstruction has been cleaned, the operator will cause the cable to advance at full rpm to the next obstruction, and so on. When a particularly difficult obstruction is encountered, as evidence by the appearance of the cable, or slippage of clutch 41, or both, the operator may cause the cleaning tool to shift back and forth (i.e. forward and reverse) until it finally works its way through the obstruction. This is very easily done with the machine of the present invention which is capable of instant direction change at maximum torque. Direction change does not require that the engine 4 be powered down, or that a clutch be depressed, or that gears be shifted. It is only necessary to manipulate the single control lever 27 forwardly of the longitudinal center of slot 39 for forward movement of the cable and cleaning tool, or rearwardly of the longitudinal slot center for rearward movement of the cleaning tool and cable. When the cable and cleaning tool have reached their maximum forward position within the pipe to be cleaned, the operator, with 1,000 rpm and full torque available in reverse, will quickly withdraw the cable and cleaning tool from the sewer line and finish cutting in reverse any small final obstructions. By virtue of its instant direction change between forward and reverse, an experienced operator can minimize cable kinkage and maximize pipe cleaning per time period.

From the above, it will be evident that the sewer cleaning machine of the present invention provides full torque in either direction above 50 rpm. The machine further provides full speed control in either direction with instantaneous reversal of direction. As a result, the sewer cleaning machine of the present invention can provide maximum cutting ability at any forward or reverse speed above 50 rpm. Since there is no shifting to low gear for maximum torque, as is true of prior art machines provided with clutch and transmission assemblies, the sewer cleaning machine of the present invention can cut through obstructions at faster speeds and at maximum torque. Above 50 rpm, torque is not speed dependent.

Modifications may be made in the invention without departing from the spirit of it.

What is claimed:

1. A sewer cleaning machine of the type which rotates an elongated cable, said cable rotating a cleaning tool and shifting said cleaning tool along the interior of a sewer pipe to remove obstructions therefrom, said machine comprising a prime mover having a constant speed output shaft, a hydraulic pump having an input shaft coupled to said prime mover output shaft, a reservoir for hydraulic fluid having outlet and return ports connected to said hydraulic pump, a hydraulic motor having an output shaft operatively coupled to said cable, said hydraulic motor being connected by a pair of high pressure hydraulic fluid lines to said hydraulic pump and being driveable by said hydraulic pump, a remotely actuable control valve associated with said hydraulic pump and comprising a flow rate and flow direction control for said hydraulic fluid from said hydraulic pump to said hydraulic motor, said remotely actuable control valve further comprising a control for the speed of rotation and the direction of rotation and shifting of said cable and said cleaning tool, said hydraulic motor having a rpm range, said cable having maximum torque imparted thereto by said hydraulic motor throughout 95% of said rpm range of said hydraulic motor in either direction of rotation.

2. The sewer cleaning machine claimed in claim 1 including a wheeled base, said prime mover, said hydraulic pump and control valve, and said hydraulic motor being supported on said base, said hydraulic fluid reservoir being located beneath said base.

3. The sewer cleaning machine claimed in claim 2 wherein said reservoir comprises an integral part of said base, baffles being provided within said reservoir.

4. The sewer cleaning machine claimed in claim 1 wherein said prime mover is chosen from the class consisting of a gasoline engine, a diesel engine and an electric motor.

5. The sewer cleaning machine claimed in claim 1 wherein said hydraulic pump is a movable swashplate pump.

6. The sewer cleaning machine claimed in claim 1 wherein said hydraulic pump is a geared pump.

7. The sewer cleaning machine claimed in claim 1 including a slipclutch having an input shaft and an output shaft, said output shaft of said hydraulic motor being coupled to said input shaft of said slip clutch, said slip clutch output shaft being coupleable to said cable.

8. The sewer cleaning machine claimed in claim 6 wherein said slip clutch comprises an adjustable dual disk slip clutch.

9. The sewer cleaning machine claimed in claim 1 wherein said pump has an outlet, a manual relief valve on said pump that, when actuated, connects the outlet of said pump directly to said reservoir and relieves said motor of static pressure.

10. The sewer cleaning machine claimed in claim 1 including a manual control lever pivotally mounted on said machine, a push-pull cable operatively connecting said control lever to said control valve, said control lever being shiftable between a neutral position wherein said control valve causes hydraulic fluid to circulate between said reservoir and said control valve and said hydraulic motor is unactuated, a forward position wherein said control valve rotates said hydraulic motor output shaft in a forward direction causing said cleaning tool and said cable to advance in a forward direction in a pipe to be cleaned, and a rearward position wherein said control valve rotates said hydraulic motor output shaft in a rearward direction causing said cleaning tool and cable to shift in a rearward direction in said pipe, said hydraulic motor being substantially instantly shiftable by said control lever and control valve between said forward and rearward directions, said hydraulic motor output shaft rpm's increase as said lever shifts from said neutral position toward said forward position and from said neutral position toward said rearward position.

11. The sewer cleaning machine claimed in claim 10 including a wheeled base, said prime mover, said hydraulic pump and control valve, and said hydraulic motor being supported on said base, said reservoir being located beneath said base, said base having forward and rearward ends, a handle assembly being affixed to said rearward end of said base, said control lever being mounted on said handle assembly.

12. The sewer cleaning machine claimed in claim 11 wherein said prime mover is chosen from the class consisting of a gasoline engine, a diesel engine and an electric motor.

13. The sewer cleaning machine claimed in claim 12 including a slipclutch having an input shaft and an output shaft, said output shaft of said hydraulic motor being coupled to said input shaft of said slip clutch, said slip clutch output shaft being coupleable to said cable.

14. The sewer cleaning machine claimed in claim 13 wherein said pump has an outlet, a manual relief valve on said pump that, when actuated, connects the outlet of said pump directly to said reservoir and relieves said motor of static pressure.

15. The sewer cleaning machine claimed in claim 14 wherein said hydraulic pump is a movable swashplate pump.

16. The sewer cleaning machine claimed in claim 15 wherein said hydraulic pump is a geared pump.

17. The sewer cleaning machine claimed in claim 16 wherein said slip clutch comprises an adjustable duel disk slip clutch.

18. The sewer cleaning machine claimed in claim 17 wherein said reservoir comprises an integral part of said base, baffles being provided within said reservoir.

* * * * *

UNITED STATES PATENT AND TRADEMARK OFFICE

CERTIFICATE OF CORRECTION

PATENT NO. : 5,875,508
DATED : March 2, 1999
INVENTOR(S) : C. David Hale

It is certified that error appears in the above-indentified patent and that said Letters Patent is hereby corrected as shown below:

Column 6, line 34, (claim 8) "in claim 6" should read - - in claim 7 - -

Signed and Sealed this

Twenty-ninth Day of June, 1999

*Attest:*

Q. TODD DICKINSON

*Attesting Officer*

*Acting Commissioner of Patents and Trademarks*